US005945023A

United States Patent [19]

Yang

[11] Patent Number: 5,945,023

[45] Date of Patent: Aug. 31, 1999

[54] MICROWAVE OVEN HAVING MOISTURE DRAIN HOLES

[75] Inventor: Ha-yeong Yang, Kyungki-Do, Rep. of Korea

[73] Assignee: Samsung Electronics Co., Ltd., Suwon, Rep. of Korea

[21] Appl. No.: 09/064,737

[22] Filed: Apr. 23, 1998

[30] Foreign Application Priority Data

Aug. 23, 1997 [KR] Rep. of Korea ..... 97-40424

[51] Int. Cl.[6] ..... H05B 6/64

[52] U.S. Cl. ..... 219/756; 219/757

[58] Field of Search ..... 219/678, 756, 219/757, 733; 426/234

[56] References Cited

U.S. PATENT DOCUMENTS 3,920,944 11/1975 Constable ..... 219/685

4,335,289 6/1982 Smith ..... 219/749

*Primary Examiner*—Tu B. Hoang

*Attorney, Agent, or Firm*—Burns, Doane, Swecker & Mathis, L.L.P.

[57] ABSTRACT

A microwave oven includes a cooking chamber and an electronic component compartment separated from one another by a partition wall. Air inlet holes are formed in an upper portion of the partition wall, and air outlet holes are formed in another wall of the cooking chamber to enable air to be circulated through the cooking chamber by a fan disposed in the electrical component compartment. First drain holes are formed in a lower portion of the partition wall diagonally opposite the air inlet holes to enable condensed moisture formed in the cooking chamber to drain into the electrical component compartment. That moisture exits the electrical component chamber through second drain holes formed in the floor of the electrical component compartment. A barrier is disposed in the electrical component compartment to surround the first and second drain holes, thereby preventing moisture from reaching any of the electrical components.

6 Claims, 4 Drawing Sheets

111
115
116a
116
117
116c
116b 100
120
121
140
141
112
111
134
113
114
130
135
131
133
132

MICROWAVE OVEN HAVING MOISTURE DRAIN HOLES

BACKGROUND OF THE INVENTION (1) Field of the Invention

The present invention relates to a microwave oven, and more particularly, to a microwave oven having a fan for circulating air through a cooking chamber.

(2) Description of the Prior Art

Generally, a microwave oven is a cooking appliance which cooks food by frictional heat generated by making the molecules of the food being cooked move at high speeds with the use of microwaves.

Referring to FIGS. 1 and 2, shown respectively are an exploded perspective view of a conventional microwave oven and a front view of the microwave oven illustrated in FIG. 1.

As shown in drawings, the conventional microwave oven comprises a main body 10 defining an exterior of the microwave oven, a cooking chamber 20 having predetermined dimensions and inside of which food to be cooked is placed, and an electrical component compartment 30 provided to one side of the cooking chamber 20. Provided on a front of the microwave oven are a door 40 for opening and closing the cooking chamber 20, the door 40 being attached by hinge members (not shown), and a control panel 41 which is manipulated by the user to make various selections for the cooking of food.

The electrical component compartment 30, within which many electrical components for radiating microwaves are disposed, is separated from the cooking chamber 20 by a partition wall 11. Mounted inside the electrical component compartment 30 are a transformer 31 for raising a level of voltage supplied from an external electric power source, a magnetron 32 for generating microwaves using the high voltage supplied from the transformer 31 and radiating the microwaves into the cooking chamber 20, a fan 34 for cooling the various electrical components in the electrical component compartment 30 by drawing external air therein through a plurality of air holes 14 formed on a rear wall 13, and a guide duct 33 for directing the external air drawn into the electrical component compartment 30 by the fan 34 to the cooking chamber 20.

In addition, it is possible to dispose a heater 50 for grilling food in an upper portion of the cooking chamber 20.

A plurality of inlet holes 12, through which external air drawn into the electrical component compartment 30 by the fan 34 and directed by the guide duct 33 flows into the cooking chamber 20, are formed in the partition wall 11 which separates the cooking chamber 20 from the electrical component compartment 30. The inlet holes 12 are located on a forward, upper corner of the partition wall 11 corresponding to the positioning of an outlet of the guide duct 33.

Further, a plurality of outlet holes 22, through which the external air drawn into the cooking chamber 20 is exhausted to the outside of the cooking chamber 20, are formed in a side wall 21, which is opposite to the partition wall 11. The outlet holes 22 are located on a rearward, upper corner of the side wall 21.

With the above structure, external air drawn into the electrical component compartment 30 by the fan 34 flows into the cooking chamber 20 through the guide duct 33 and inlet holes 12, and is exhausted to the outside of the cooking chamber 20 through the outlet holes 22 as shown by the arrow of FIG. 2, thereby removing moisture vapor and odors generated from the cooking of food in the cooking chamber 20.

However, after cooking food using the conventional microwave oven structured as described above condensed, moisture remains in the cooking chamber, necessitating the wiping of the excess moisture by the user. That is, although some moisture evaporated from food cooked in the cooking chamber is partially removed by the air circulated through the cooking chamber by the fan, much moisture remains in the cooking chamber. In particular, an excessive amount of moisture gathers in a rearward, lower corner of the cooking chamber formed by the partition wall, a floor, and a back wall of the cooking chamber.

SUMMARY OF THE INVENTION

The present invention has been made in an effort to solve the above described problems.

It is an object of the present invention to provide a microwave oven which can discharge moisture in a cooking chamber to an outside of the microwave oven.

To achieve the above object, a microwave oven according to the present invention includes a main body, a cooking chamber provided in the main body, an electrical component compartment separated from the cooking chamber by a partition wall for housing electrical components including a magnetron and a fan. The fan is arranged for drawing external air into the electrical component compartment and cooling electrical components therein. A plurality of air inlet holes is formed in the partition wall through which the external air drawn by the fan flows into the cooking chamber. A plurality of air outlet holes is formed in an upper portion of another wall of the cooking chamber through which the external air drawn into the cooking chamber is exhausted. A plurality of drain holes is provided in a lower portion of a wall of the cooking chamber for exhausting moisture outside of the cooking chamber.

The wall in which the drain holes are formed preferably comprises the partition wall.

The drain holes are preferably formed in a lower rearward portion of the partition wall diagonally from the air inlet holes.

A blocking plate is preferably provided in the electrical component compartment in surrounding relationship to the drain holes for preventing moisture exhausted from the cooking chamber through the drain holes from contacting electrical components disposed in the electrical component compartment.

The drain holes constitute first drain holes. A plurality of second drain holes is formed in a floor of the electrical component compartment and is surrounded by the blocking plate for externally discharging from the electrical component compartment moisture exhausted into the electrical component compartment through the first drain holes.

The invention also relates to a microwave oven having a main body, a cooking chamber provided in the main body, and an electrical component compartment separated from the cooking chamber by a partition wall for housing electrical components including a magnetron and a fan. The fan is arranged for drawing external air into the electrical component compartment for cooling electrical components disposed therein. A plurality of air inlet holes is formed in the partition wall through which the external air drawn by the fan flows into the cooking chamber. A plurality of air outlet holes is formed in another wall of the cooking chamber through which the external air drawn into the cooking chamber is exhausted. A plurality of drain holes is provided in the partition wall in spaced relationship to the air inlet holes, for exhausting condensed moisture from the cooking chamber.

BRIEF DESCRIPTION OF THE DRAWINGS

The above object, and other features and advantages of the present invention will become more apparent by describing preferred embodiments thereof in detail with reference to the attached drawings, in which.

DETAILED DESCRIPTION OF PREFERRED EMBODIMENT

A preferred embodiment of the present invention will now be described in detail with reference to the accompanying drawings.

Figure 1:
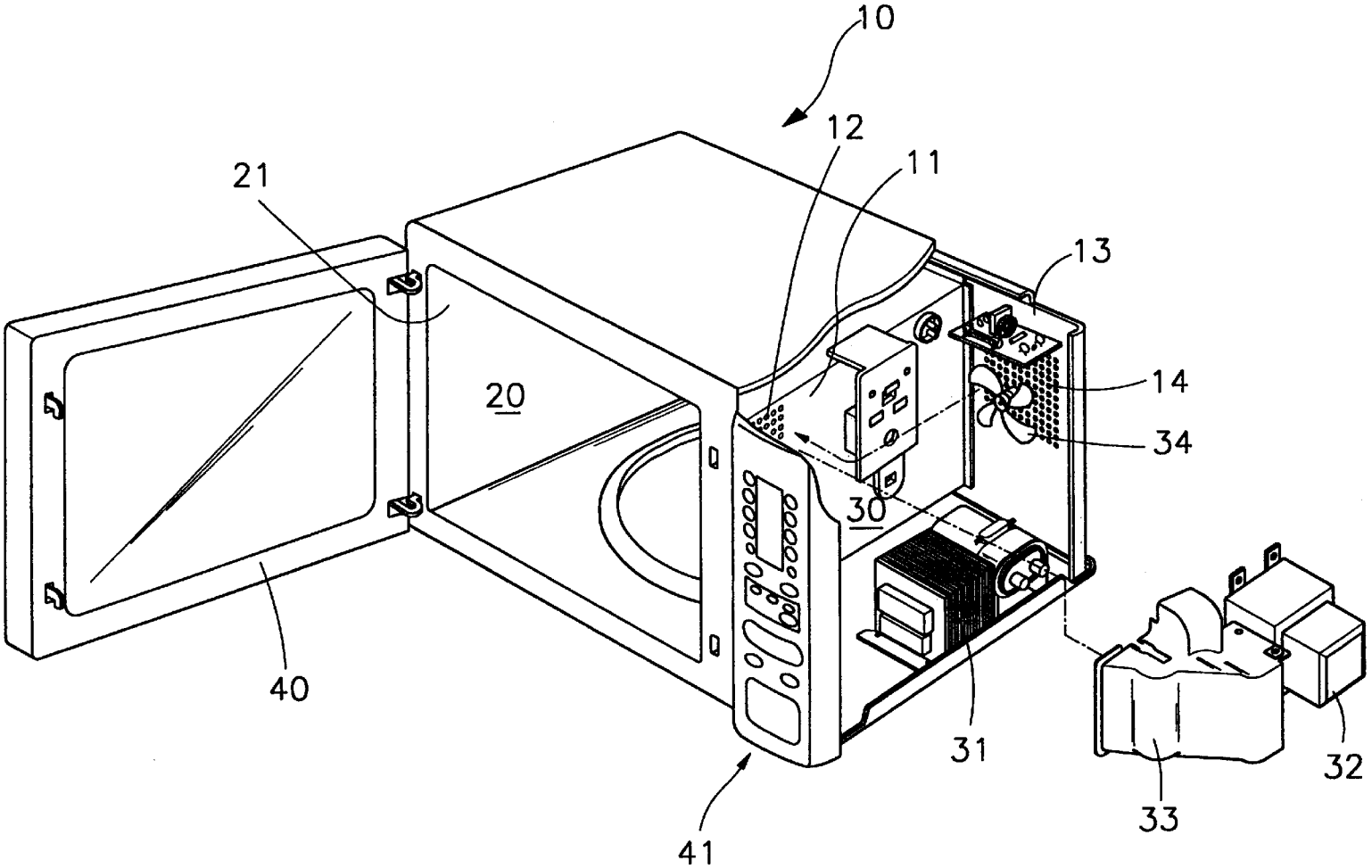
FIG. 1 (PRIOR ART)
FIG. 1 is an exploded perspective view of a conventional microwave oven.
Figure 2:
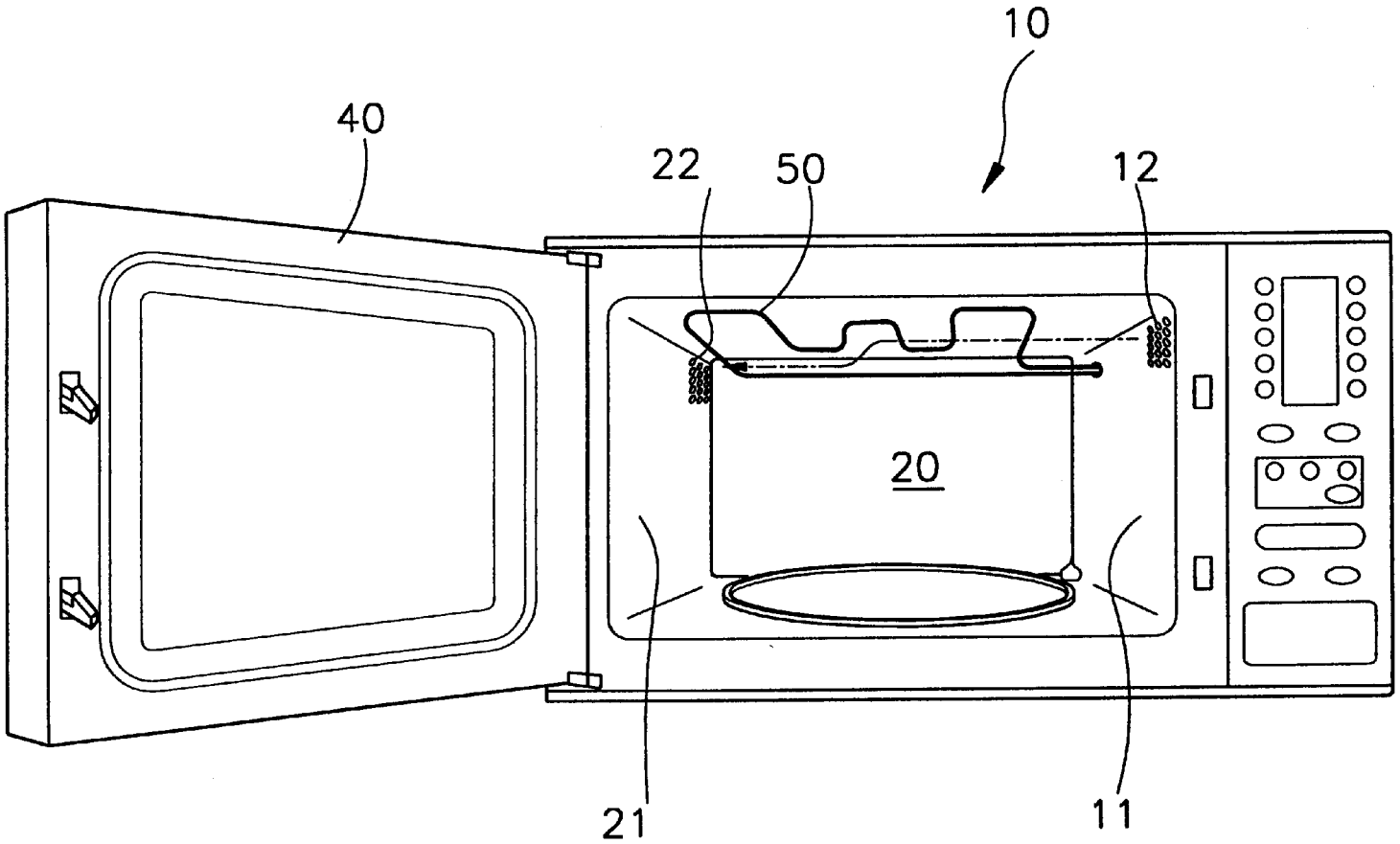
FIG. 2 (PRIOR ART)
FIG. 2 is a front view of the microwave oven shown in FIG. 1.
Figures 3, 3A:
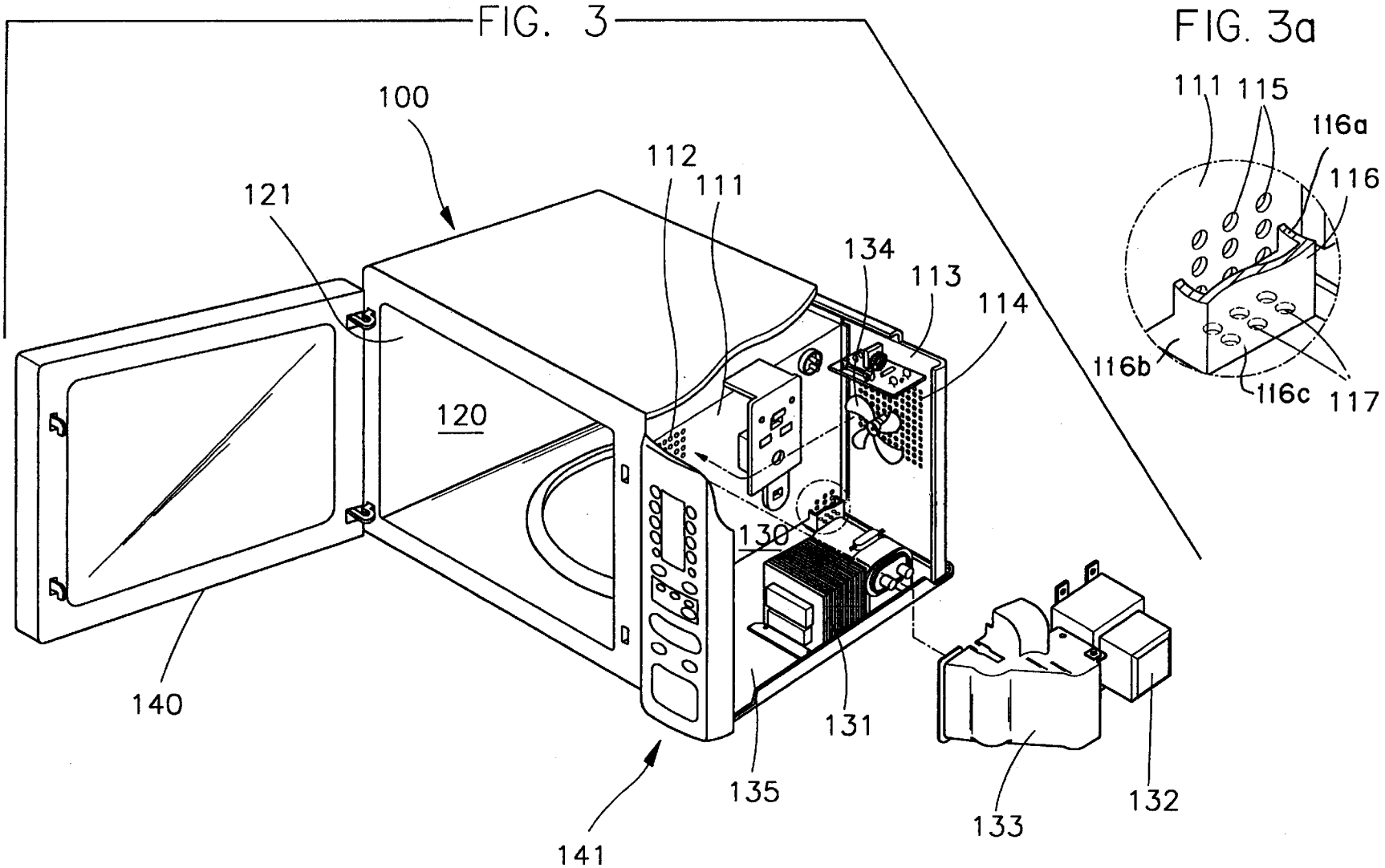
FIG. 3 is an exploded perspective view of a microwave oven according to a preferred embodiment of the present invention.
FIG. 3*a* is an enlarged view of an encircled fragment of FIG. 3.
Figure 4:
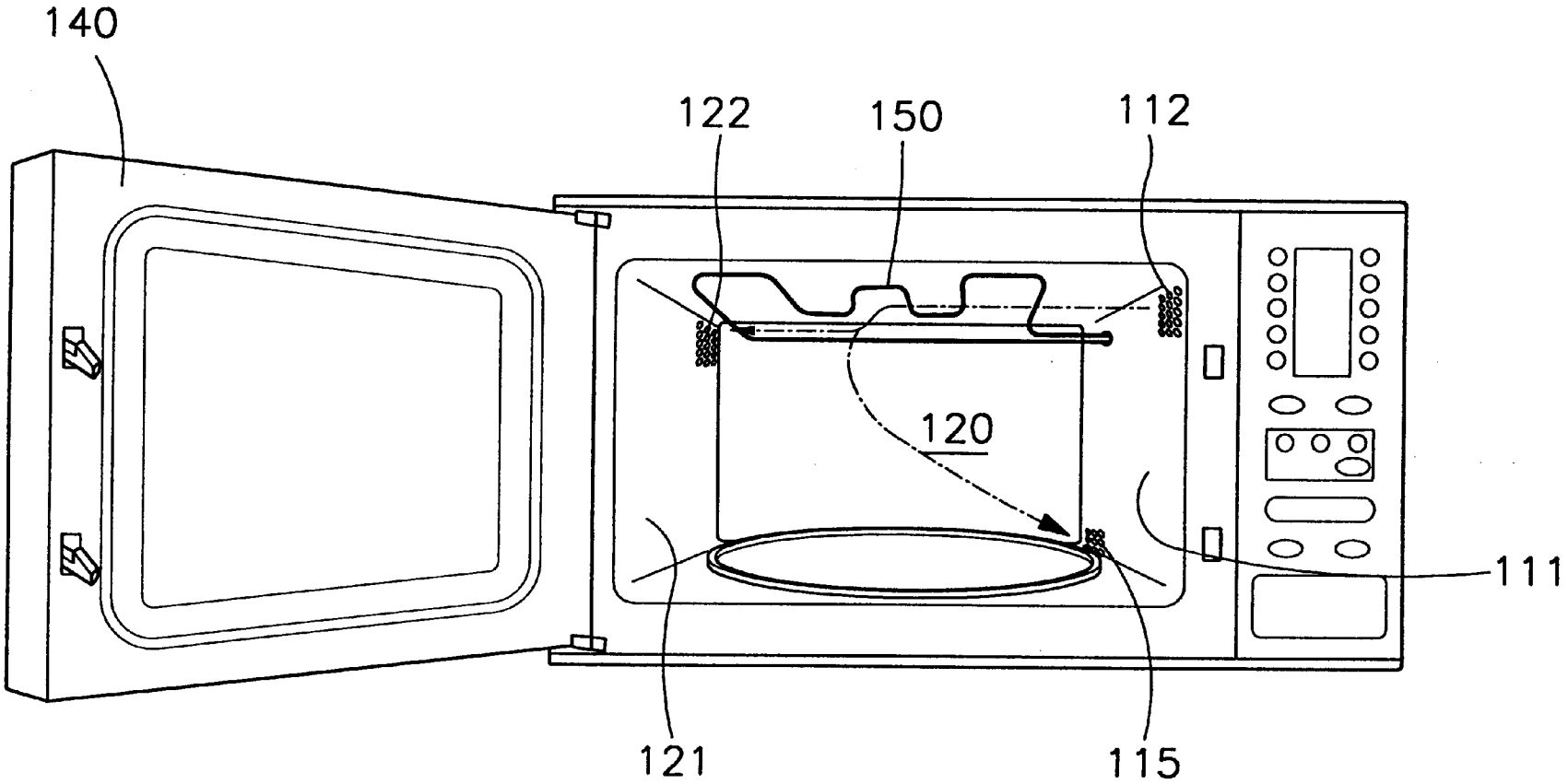
FIG. 4 is a front view of the microwave oven shown in FIG. 3.

As shown in FIGS. 3, 3*a*, and 4, the inventive microwave oven comprises a main body 100 defining an exterior of the microwave oven, a cooking chamber 120 formed having predetermined dimensions and inside of which food to be cooked is placed, and an electrical component compartment 130 provided to one side of the cooking chamber. Provided on a front of the microwave oven are a door 140 for opening and closing the cooking chamber 120, the door 140 being attached by hinge members (not shown), and a control panel 141 which is manipulated by the user to make various operational selections for the cooking of food.

The electrical component compartment 130, within which many electrical components for radiating microwaves are disposed, is separated from the cooking chamber 120 by a partition wall 111. Mounted inside the electrical component compartment 130 are a transformer 131 for raising a level of voltage supplied from an external electric power source, a magnetron 132 for generating microwaves using the high voltage supplied from the transformer 131 and radiating the microwaves to the cooking chamber 120, a fan 134 for cooling the various electrical components in the electrical component compartment 130 by drawing external air therein through a plurality of air holes 114 formed on a rear wall 113 of the main body 100, and a guide duct 133 for directing the external air drawn into the electrical component compartment 130 by the fan 134 to the cooking chamber 120.

In addition, it is possible to dispose a heater 150 for grilling food in an upper portion of the cooking chamber 120.

A plurality of inlet holes 112, through which the external air drawn into the electrical component compartment 130 by the fan 134 and directed by the guide duct 133 flows into the cooking chamber 130, are formed in the partition wall 111 which separates the cooking chamber 120 from the electrical component compartment 130. The inlet holes 112 are located in a forward, upper corner of the partition wall 111 corresponding to the positioning of an outlet of the guide duct 133.

Further, a plurality of outlet holes 122, through which the external air drawn into the cooking chamber 120 is exhausted to the outside of the cooking chamber 120, are formed in a side wall 121, which is opposite and parallel to the partition wall 111. The outlet holes 122 are located in a rearward, upper corner of the side wall 121.

In the above structure, external air drawn into the electrical component compartment 130 by the fan 134 flows into the cooking chamber 120 through the guide duct 133 and inlet holes 112, and is exhausted to outside of the cooking chamber 120 through the outlet holes 122, thereby removing odors and moisture vapor generated from the cooking of food in the cooking chamber 120.

In addition, the inventive microwave oven provides a plurality of first drain holes 115 formed in the partition wall 111 diagonally from the inlet holes 112. The first drain holes 115 allow the discharge of moisture collected in a corner formed by the partition wall 111, a back wall, and a floor of the cooking chamber 120.

The positioning of the first drain holes 115 is dependent upon the location of the inlet and outlet holes 112 and 122. That is, if the inlet holes 112 are formed in a rearward, upper portion of the partition wall 111 and the outlet holes 122 are formed in a frontward, upper portion of the side wall 121, it is preferable to form the first drain holes 115 diagonally from the inlet holes 112 in a frontward, lower portion of the partition wall 111. However, the ideal positioning of the inlet and outlet holes 112 and 122 is shown in the drawing, i.e., the first drain holes 115 are provided in a rearward, lower corner of the partition wall 111.

In the above structure, external air directed into the cooking chamber 120 through the guide duct 133 and inlet holes 112 is exhausted to the outside of the cooking chamber 120 through both the outlet holes 122 and the first drain holes 115 as shown by the arrows of FIG. 4. Condensed moisture collecting in the corner formed by the partition wall 111, the back wall, and the bottom of the cooking chamber 120 flows through the first drain holes 115.

Further, a blocking plate 116 is provided in the electrical component compartment 130 surrounding the first drain holes 115. As shown in FIG. 3*a*, the blocking plate 116 includes two lateral walls 116*a*, 116*b* formed integrally with a floor 135 of the electrical component compartment 130 and extending into the same from the partition wall 111 at a predetermined distance on both sides of the first drain holes 115. The plate 116 also includes a connecting wall 116*c* formed integrally with the floor 135 of the electrical component compartment 130 and interconnecting the lateral walls 116*a*, 116*b*. Accordingly, condensed moisture draining into the compartment 130 through the first drain holes 115 does not make contact with the electrical components in the electrical component compartment 130.

In addition, a plurality of second drain holes 117 is formed in the floor 135 of the electrical component compartment 130 within a portion of the floor 135 enclosed by the blocking plate 116. As a result, moisture exhausted from the cooking chamber 120 through the first drain holes 115 is exhausted to the outside of the main body 100 through the second drain holes 117.

The operation of the inventive microwave oven structured as described above will be described hereinafter.

Once power is applied to the microwave oven, the transformer 131 raises a level of voltage, and the magnetron 132 produces microwaves using high voltage supplied from the transformer 131 and radiates microwaves to the cooking chamber 120, thereby cooking the food therein. In the case of a microwave oven using the heater 150, food is grilled by heat emitted by the same.

During the operation of the microwave oven, external air for cooling the electrical components is drawn into the electrical component compartment 130 by the fan 134. Further, the external air flows into the cooking chamber 120 through the guide duct 133 and the inlet holes 112, and is discharged to the outside of the main body 100 through the outlet holes 122 whereby odors and moisture vapors generated from the cooking food in the cooking chamber 120 are removed. Condensed moisture (liquid) collecting in a rear corner of the cooking chamber at the partition wall, drains from the oven through the drain holes 115 and 117.

As described above, the microwave oven according to a preferred embodiment of the present invention provides, in addition to the outlet holes, first and second pluralities of drain holes formed respectively in the partition wall and the floor of the electrical component compartment for discharging moisture in the cooking chamber to the outside of the main body. Therefore, there is no need by the user to wipe excess water left in the cooking chamber after the cooking of food. Also, excess moisture collecting in the rearward, bottom corner of the cooking chamber is removed, thereby further providing improved convenience to the user and improving the cleanliness of the cooking chamber.

While the invention has been described in connection with what is presently considered to be most practical and preferred embodiment, it is to be understood that the invention is not limited to the disclosed embodiment, but, on the contrary, is intended to cover various modifications and equivalent arrangements included within the spirit and scope of the appended claims.

What is claimed is:

1. A microwave oven having a main body; a cooking chamber provided in the main body; an electrical component compartment separated from the cooking chamber by a partition wall for housing electrical components including a magnetron and a fan; the fan arranged for drawing external air into the electrical component compartment for cooling electrical components disposed therein; a plurality of air inlet holes formed in the partition wall through which the external air drawn by the fan flows into the cooking chamber; a plurality of air outlet holes formed in an upper portion of another wall of the cooking chamber through which the external air drawn into the cooking chamber is exhausted; and a plurality of drain holes provided in a lower portion of a wall of the cooking chamber for draining condensed moisture from the cooking chamber.

2. A microwave oven of claim 1, wherein the wall in which said drain holes are formed comprises the partition wall.

3. A microwave oven according to claim 2 wherein the air inlet holes are formed in an upper portion of the partition wall; the drain holes being formed in a lower portion of the partition wall diagonally from the air inlet holes.

4. A microwave oven of claim 2, further including a blocking plate provided in the electrical component compartment and surrounding a portion of a floor of the electrical component compartment below the drain holes for preventing condensed moisture passing through the drain holes from contacting electrical components disposed in the electrical component compartment.

5. A microwave oven of claim 4, wherein the drain holes comprise first drain holes; a plurality of second drain holes being formed in the portion of the floor of the electrical component compartment surrounded by the blocking plate, for draining condensed moisture from the electrical component compartment.

6. A microwave oven having a main body; a cooking chamber provided in the main body; an electrical component compartment separated from the cooking chamber by a partition wall for housing electrical components including a magnetron and a fan; the fan arranged for drawing external air into the electrical component compartment for cooling electrical components disposed therein; a plurality of air inlet holes formed in an upper portion of the partition wall through which the external air drawn by the fan flows into the cooking chamber; a plurality of air outlet holes formed in an upper portion of another wall of the cooking chamber through which the external air drawn into the cooking chamber is exhausted; a plurality of first drain holes provided in a lower rear portion of the partition wall for draining condensed moisture from the cooking chamber into the electrical component compartment; a floor of the electrical component compartment including second drain holes; and a barrier wall disposed on the floor in surrounding relationship to the first and second drain holes, for confining condensed moisture to a vicinity of the second drain holes.

* * * * *